US011638096B1

(12) United States Patent
Ha

(10) Patent No.: US 11,638,096 B1
(45) Date of Patent: Apr. 25, 2023

(54) SPEAKER DRIVER

(71) Applicant: ONE HERTZ CO., LTD., Incheon (KR)

(72) Inventor: Jung Soo Ha, Goyang-si (KR)

(73) Assignee: ONE HERTZ Co., Ltd., Incheon (KR)

( * ) Notice: Subject to any disclaimer, the term of this patent is extended or adjusted under 35 U.S.C. 154(b) by 0 days.

(21) Appl. No.: 17/536,125

(22) Filed: Nov. 29, 2021

(30) Foreign Application Priority Data

Oct. 22, 2021 (KR) ..... 10-2021-0141515

(51) Int. Cl.
*H04R 7/16* (2006.01)

(52) U.S. Cl.
CPC ..... *H04R 7/16* (2013.01)

(58) Field of Classification Search
CPC ..... H04R 7/16
See application file for complete search history.

(56) References Cited

FOREIGN PATENT DOCUMENTS

KR 20140112252 A * 9/2014

* cited by examiner

*Primary Examiner* — Sunita Joshi
(74) *Attorney, Agent, or Firm* — McLean IP Global; Jason Y. Pahng

(57) ABSTRACT

Provided is a speaker driver. The speaker driver includes a pair of yoke members that is arranged to face each other so as to have empty spaces provided on inner sides thereof and fixed to a stand base, two or more magnets that are mounted on inner side surfaces of the yoke members, and a rotating member that is provided with a voice coil disposed in parallel in a direction facing the magnet and disposed between the yoke members, and has one end rotatably coupled to the yoke members and the other end provided with a diaphragm coupling part to which a diaphragm is coupled.

12 Claims, 5 Drawing Sheets

SPEAKER DRIVER

CROSS-REFERENCE TO THE RELATED APPLICATION

This application is based on and claims priority under 35 U.S.C. § 119 to Korean Patent Application No. 10-2021-0141515, filed on Oct. 22, 2021, in the Korean Intellectual Property Office, the disclosure of which is incorporated by reference herein in its entirety.

BACKGROUND

1. Field

The disclosure relates to a speaker driver.

2. Description of Related Art

In general, a speaker has a structure in which a vibrating unit that outputs a sound signal is directed in a specific direction, and a sound absorbing agent or the like is used to absorb sound in the other directions to direct the sound signal in the specific direction.

Therefore, there is a problem in that it is difficult to implement an omnidirectional speaker that outputs sound in all directions because the general speaker is directed only in the specific direction in which the sound is output.

In addition, the conventional speaker driver has a complex structure, and since it is necessary to use several speaker drivers instead of one speaker driver to cover the entire range of high, mid, and low tones, there is a problem in that the conventional speaker driver has a more complex structure in order to implement a speaker driver that outputs a full range sound.

SUMMARY

The present disclosure implements an omnidirectional speaker driver with a simple structure in a speaker driver and provides a speaker driver capable of covering the entire range of high, mid, and low tones.

In addition, problems of the present embodiments are not limited thereto, and other problems not mentioned will be clearly understood by those skilled in the art from the following description.

According to an embodiment, there is provided a speaker driver including a pair of yoke members that is arranged to face each other so as to have empty spaces provided on inner sides thereof and fixed to a stand base; two or more magnets that are mounted on inner side surfaces of the yoke members; and a rotating member that is provided with a voice coil disposed in parallel in a direction facing the magnet and disposed between the yoke members, and has one end rotatably coupled to the yoke member and the other end provided with a diaphragm coupling part to which a diaphragm is coupled.

BRIEF DESCRIPTION OF THE DRAWINGS

The above and other aspects, features, and advantages of certain embodiments of the disclosure will be more apparent from the following description, taken in conjunction with the accompanying drawings, in which.

DETAILED DESCRIPTION

Figure 1:
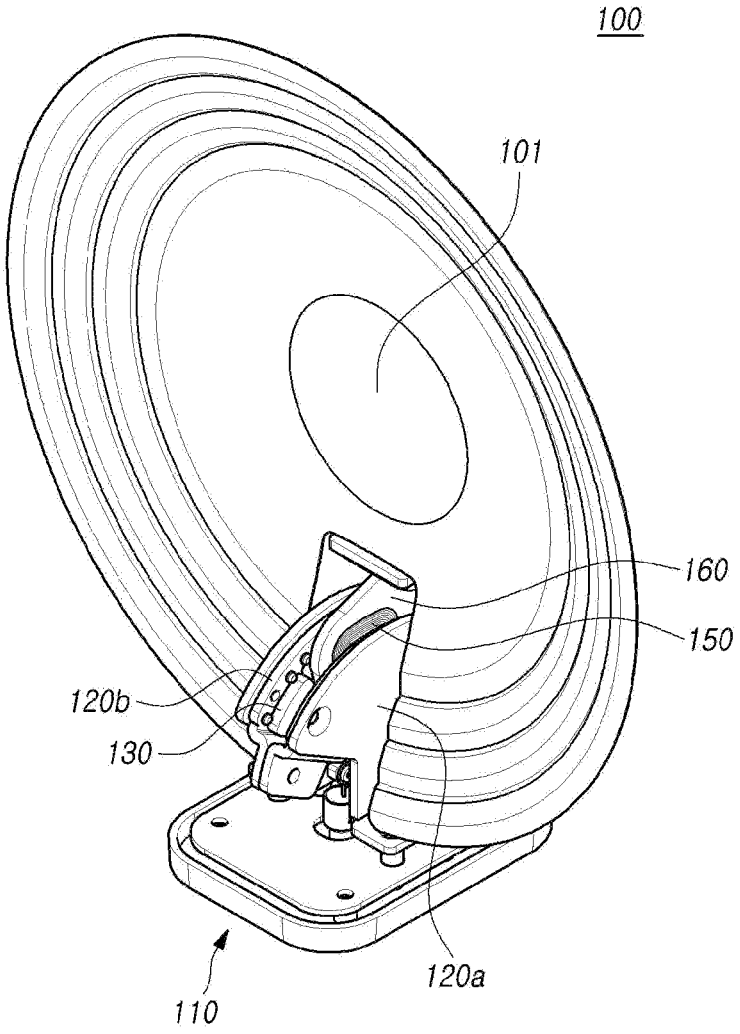
FIGS. 1 and 2 are perspective views illustrating a speaker driver according to the present embodiments.

Hereinafter, exemplary embodiments of the present disclosure will be described in detail with reference to the accompanying drawings. In adding reference numerals to components of each drawing, the same components will be denoted by the same reference numerals even though they are illustrated in different drawings. Further, in describing the present embodiments, well-known functions or constructions will not be described in detail since they may unnecessarily obscure the understanding of the present technology. When "includes", "having", "formed of", etc. mentioned in this specification are used, other parts may be added unless "only" is used. When a component is expressed in the singular, it may include a case in which the plural is included unless otherwise explicitly stated.

In addition, terms 'first', 'second', A, B, (a), (b), and the like, will be used in describing components of the present disclosure. These terms are used only in order to distinguish the components from other components, and the nature, sequence, order, or the like, of the corresponding components are not limited by these terms.

In description of a positional relationship of components, when it is described that two or more components are "connected", "coupled", or "combined", etc., two or more components may be directly "connected", "combined" or "connected", but it should be understood that two or more components and other components may be further "interposed" and "connected," "coupled," or "combined". Here, other components may be included in one or more of two or more components that are "connected", "coupled", or "combined" to each other.

In the description of the temporal flow relation related to the components, the operation method, the production method, etc., for example, when the temporal relationship or the streamline relationship of "~after", "~subsequent to", "~next", "~before", etc., is described, it may include cases that are not continuous unless "immediately" or "directly" is used.

Meanwhile, when a numerical value or its corresponding information (e.g., level, etc.) is mentioned in a component, even if there is no explicit description, the numerical value or its corresponding information may be interpreted as including an error range that may occur due to various factors (e.g., process factors, internal or external shock, noise, etc.).

Figure 2:
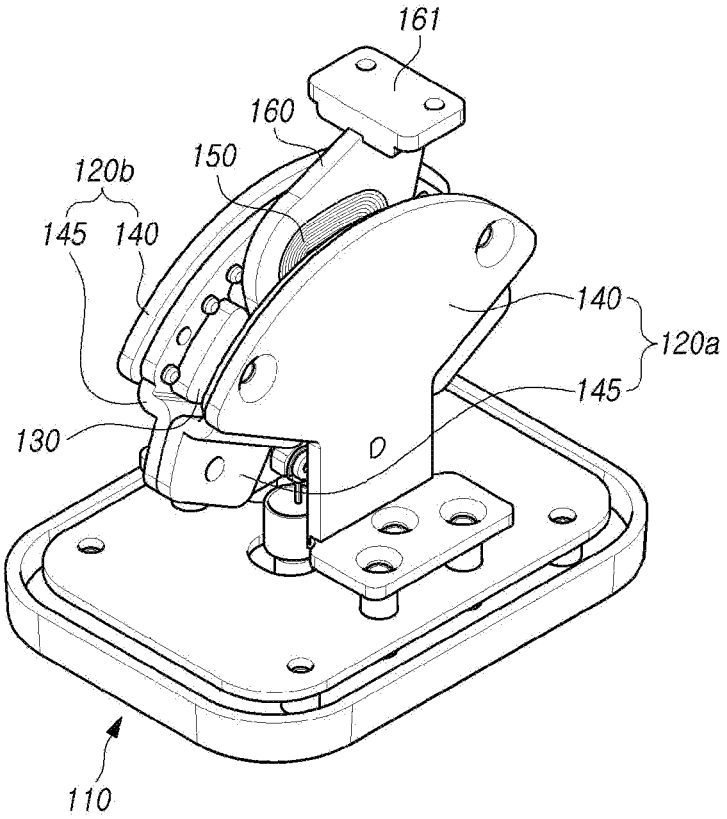
Figure 3:
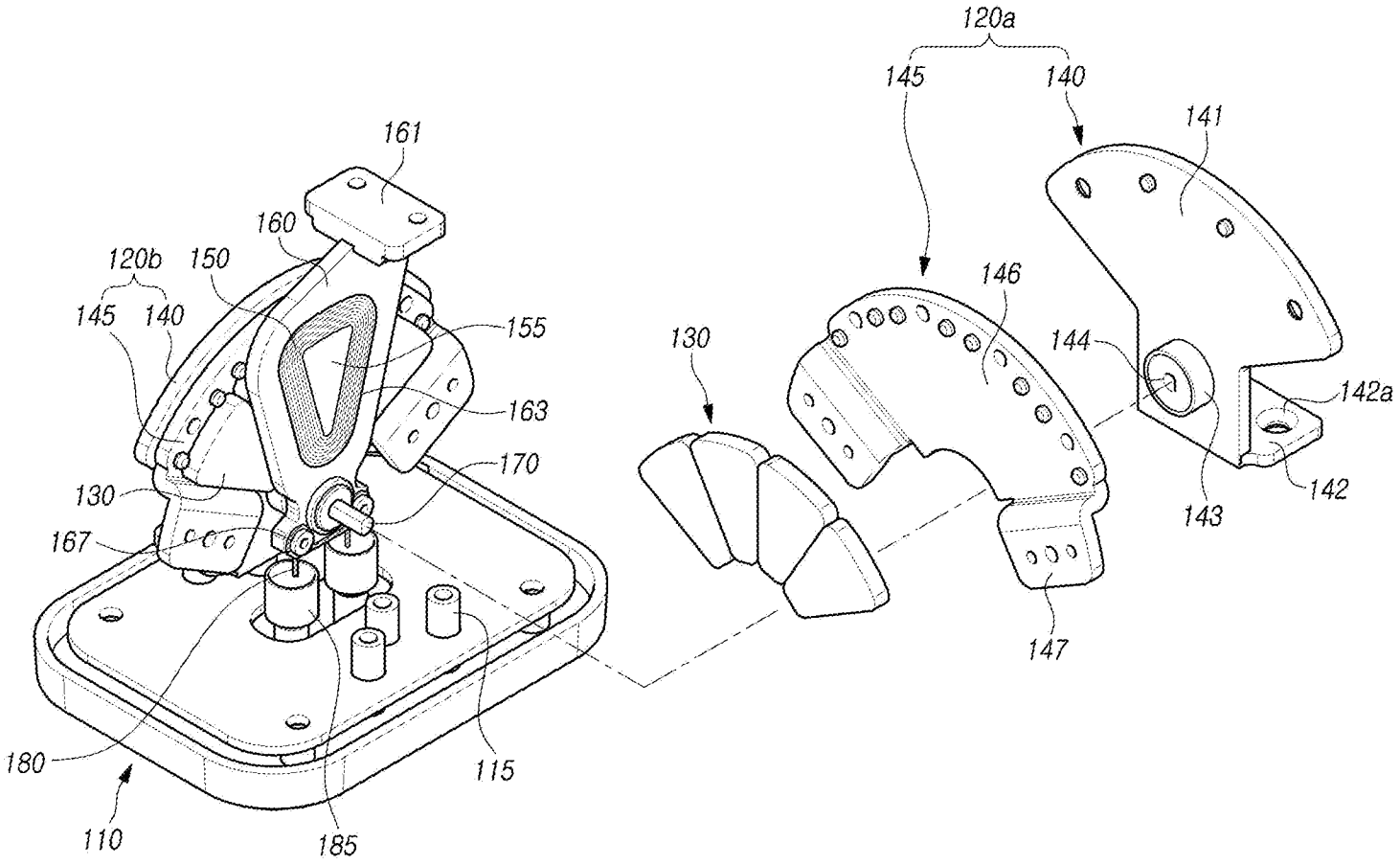
FIG. 3 is an exploded perspective view illustrating some of the speaker drivers according to the present embodiments.
Figure 4:
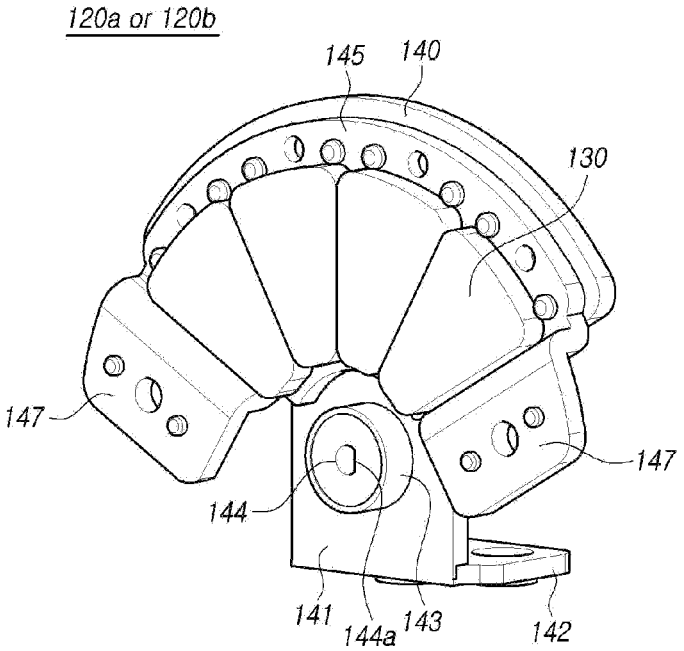
FIG. 4 is a perspective view illustrating some of the speaker drivers according to the present embodiments.
Figure 5:
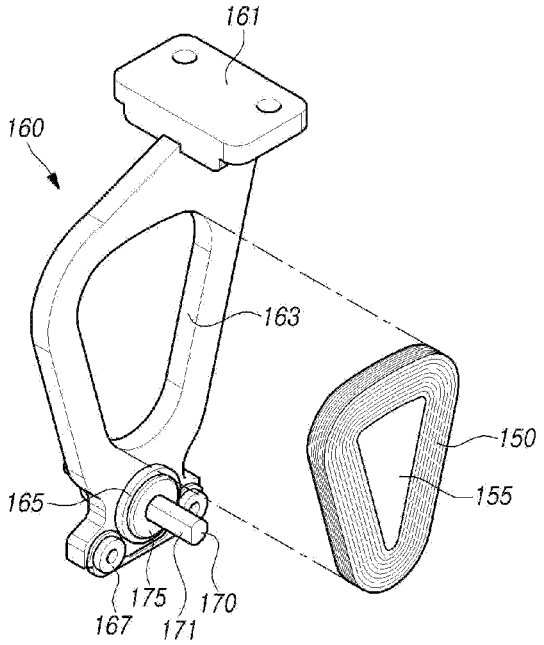
FIG. 5 is an exploded perspective view illustrating some of the speaker drivers according to the present embodiments.
Figure 6:
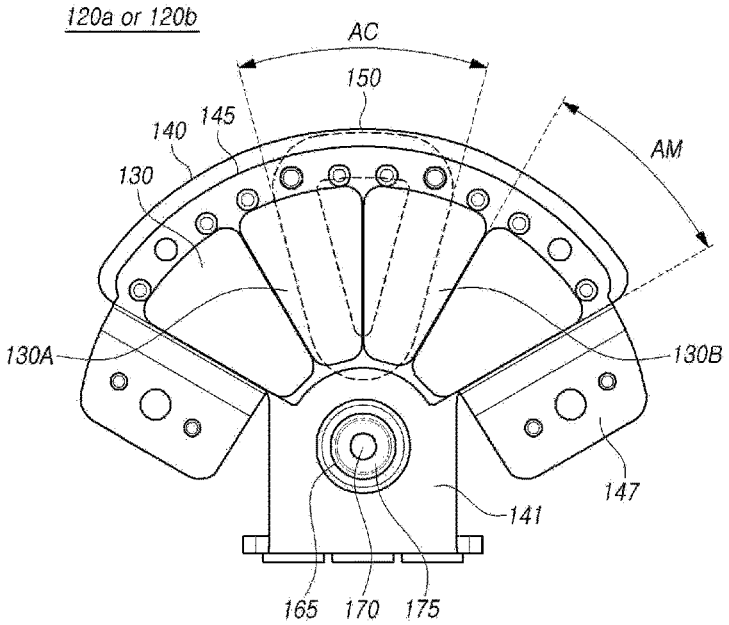
FIGS. 6 and 7 are front views illustrating some of the speaker drivers according to the present embodiments.
Figure 7:
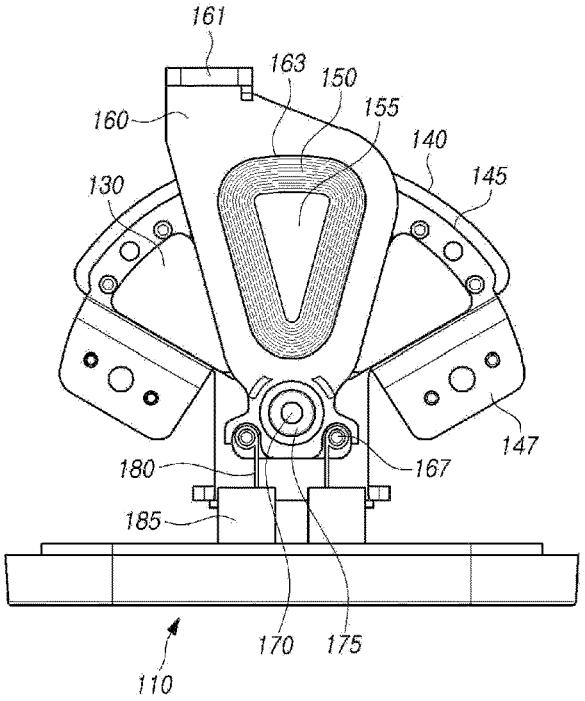

FIGS. 1 and 2 are perspective views illustrating a speaker driver according to the present embodiments, FIG. 3 is an exploded perspective view illustrating some of the speaker drivers according to the present embodiments, FIG. 4 is a perspective view illustrating some of the speaker drivers according to the present embodiments, FIG. 5 is an exploded perspective view illustrating some of the speaker drivers according to the present embodiments, and FIGS. 6 and 7 are front views illustrating some of the speaker drivers according to the present embodiments.

As illustrated in these drawings, a speaker driver 100 includes a pair of yoke members 120*a* and 120*b* that is arranged to face each other so as to have empty spaces provided on inner sides thereof and fixed to a stand base 110, two or more magnets 130 that are mounted on inner side surfaces of the yoke members 120*a* and 120*b*, and a rotating member 160 that is provided with a voice coil disposed in parallel in a direction facing the magnet and disposed between the yoke members 120*a* and 120*b*, and has one end rotatably coupled to the yoke members 120*a* and 120*b* and the other end provided with a diaphragm coupling part 161 to which a diaphragm 101 is coupled.

The speaker driver 100 according to the present embodiments has a structure in which the rotating member 160 rotates in one direction and the other direction between the pair of yoke members 120*a* and 120*b* disposed to face each other to drive the diaphragm 101.

The speaker driver 100 is mounted on an installation by the stand base 110 and may include a housing enclosing them, a power supply unit for supplying power to the voice coil 150, an amplifier, etc., and in the present embodiments, for convenience of understanding, in the drawings and detailed description, the housing, the power supply unit, the amplifier, etc., will be omitted and described.

The yoke members 120*a* and 120*b* fixed to the stand base 110 are formed in pair and are disposed to face each other, and empty spaces are provided on inner sides thereof, so two or more magnets 130 are mounted on inner side surfaces of the yoke members 120*a* and 120*b*.

The rotating member 160 disposed between the yoke members 120*a* and 120*b* is provided with a voice coil 150 disposed in parallel in a direction facing the magnet 130 mounted on the inner side surfaces of the yoke member 120*a*, 120*b*. Therefore, when power is applied, the rotating member 160 rotates in one direction and the other direction by interaction of a magnetic field changing according to a direction of a current and a magnetic field generated from the magnet 130.

In addition, one end of the rotating member 160 is provided with a coupling hole 165 to which the shaft 170 is coupled so that the rotating member 160 is supported by the yoke members 120*a* and 120*b* to enable rotation, and the yoke members 120*a* and 120*b* are provided with an insertion part 143 into which an end portion of the shaft 170 is inserted.

A rotation support member 175 for supporting the rotation of the rotating member 160 is provided between the outer peripheral surface of the shaft 170 and the coupling hole 165, a flat part 171 is formed at an end portion of the shaft 170 to prevent the shaft 170 from rotating, and a flat part 144*a* is also formed in an insertion hole 144 of the insertion part 143 to correspond thereto.

Each of the pair of yoke members 120*a* and 120*b* includes a magnet support member 145 that has the magnet 130 mounted on an inner side surface thereof and is provided with bent end portions 147 that are bent to be stepped in a direction in which the yoke members 120*a* and 120*b* face each other at both ends in a circumferential direction, and a yoke fixing member 140 that is coupled to an outer side surface of the magnet support member 145 and fixed to the stand base 110 and has the insertion part 143 provided on an inner side surface thereof.

The magnet support member 145 is formed in a fan shape in which an outer arc is larger than an inner arc, and is provided with a mounting part 146 mounted with the magnet 130 and the bent end portions 147 bent to be stepped in a direction in which the yoke members 120*a* and 120*b* face each other at both ends of the mounting part 146.

The pair of yoke members 120*a* and 120*b* is coupled to each other by making the bent end portions 147 of the magnet support members 145 spaced apart from each other abut in a direction facing each other, and the bent end portions 147 are provided with coupling holes to which fastening members are coupled.

The yoke fixing member 140 includes a plate part 141 that is closely attached to and coupled to the mounting part 146 of the magnet support member 145 and a fixing flange 142 that is provided with a coupling hole 142*a* bent at a lower end of the plate 141 and coupled to the fixing member 115 of the stand base 110.

The coupling hole coupled to the mounting part 146 of the magnet support member 145 with the fastening member is formed on an upper side of the plate part 141, and the yoke members 120*a* and 120*b* are protrudedly formed on the lower side of the plate part 141 in the direction facing each other and the insertion part 143 into which the end portion of the shaft 170 is inserted is formed on the lower side of the plate part 141.

The rotating member 160 is provided with a coil coupling hole 163 to which the voice coil 150 is coupled between the coupling hole 165 to which the shaft 170 is coupled and the diaphragm coupling part 161, and an upper side thereof is provided with a diaphragm coupling part 161 to which the diaphragm 101 is coupled.

The total thickness of the voice coil 150 is formed to be the same as or smaller than the thickness of the rotating member 160, and thus, when the voice coil 150 is coupled to the coil coupling hole 163, the voice coil 150 does not protrude toward front and rear surfaces of the rotating member 160.

The magnets 130 mounted on the inner side surfaces of the yoke members 120*a* and 120*b* have a fan shape or an inverted trapezoid shape which has the outer arc larger than the inner arc and a predetermined angle.

In addition, the magnet 130 is provided in the same number of one or more on both sides in the circumferential direction based on central portions of the inner side surfaces of the yoke members 120*a* and 120*b*. In the present embodiments, a total of four of yoke members 120*a* and 120*b* are illustrated as an example, two on each side in the circumferential direction based on the central portions of the inner side surfaces of the yoke members 120*a* and 120*b*.

The voice coil 150 provided in the rotating member 160 is disposed in parallel in a direction facing the magnet 130, and one or more voice coils 150 may be provided in the rotating member 160. In the present embodiments, an example in which one voice coil 150 is disposed in the central portion of the rotating member 160 is illustrated.

The voice coil 150 is formed to have a space on the inner side in the fan shape or inverted trapezoid shape having a predetermined angle.

The voice coil 150 is wound so as to generate a magnetic field when power is applied, so that the entire voice coil 150 is formed in the fan shape or inverted trapezoidal shape, and may be provided with a coil support member 155 to support the inner side of the voice coil 150.

In this way, the voice coil 150 formed in the fan shape having a predetermined angle or in the inverted digraph shape may be formed in the fan shape or inverted trapezoid shape having the same angle as the magnet 130.

In addition, the size of the magnet 130 and the voice coil 150 is formed so that an outer edge of the magnet 130 overlaps a center of the voice coil 150.

That is, when viewed from the position where the magnet 130 and the voice coil 150 overlap, the outer edge of the magnet 130 is disposed between the outer edge and the inner edge of the voice coil 150.

In addition, an initial position of the rotating member 160 is located in the centers of each of the magnets 130 adjacent to both sides of the voice coil 150 in the circumferential direction, and a boundary portion between the adjacent magnets 130 is disposed at the central portion of the voice coil, so it is possible to optimize a rotational force of the rotating member 160 by maximizing the interaction between the magnetic field generated from the magnet 130 and the magnetic field generated from the voice coil 150.

That is, as illustrated in FIG. 6, a formation angle AM of the magnet 130 and a formation angle AC of the voice coil 150 are formed to be the same, at the initial position of the rotating member 160, both sides of the voice coil 150 in the circumferential direction are located at the center of each of the adjacent magnets 130A and 130B, and the boundary portion between the adjacent magnets 130A and the magnet 130B is located in the center of the voice coil 150.

However, in the present embodiments, in order to maximize the interaction of the magnetic field, it has been described and illustrated that the magnet 130 and the voice coil 150 are formed in the fan shape or the inverted trapezoid shape having a predetermined angle, but the present embodiments are not necessarily limited. As long as the interaction of the magnetic fields may be generated, it is noted that the magnet 130 and the voice coil 150 may be formed in any shape, such as a circular shape, a square shape, or a rhombic shape.

Meanwhile, an elastic member 180 for applying an elastic force in the rotational direction of the rotating member 160 is provided between one end of the rotating member 160 and the stand base 110.

That is, as illustrated in FIG. 7, the voice coil 150 is disposed above the shaft 170 and the elastic member 180 is disposed below the shaft 170, and one end of the elastic member 180 is coupled to the fixing part 167 of the rotating member 160 and the other end of the elastic member 180 is coupled to a connecting member 185 fixed to the stand base 110.

In addition, the elastic member 180 is symmetrically disposed on and coupled to both sides of one end of the rotating member 160 and sets the initial position of the rotating member 160 in a state in which no power is applied, and performs a suspension function of the rotating member 160 by supporting the rotating member 160 in both directions when the rotating member 160 rotates the shaft 170 as an axis.

As described above, according to the present embodiments, it is possible to implement the omnidirectional speaker driver with a simple structure in the speaker driver and provide the speaker driver capable of covering the entire range of high, mid, and low tones.

The spirit of the present disclosure is illustratively described hereinabove. It will be appreciated by those skilled in the art that various modifications and alterations may be made without departing from the essential characteristics of the present disclosure. Accordingly, the present embodiments are not to limit the spirit of the present disclosure, but are to describe the spirit of the present disclosure. The scope of the present disclosure is not limited to these exemplary embodiments. The scope of the present disclosure should be interpreted by the following claims, and it is to be interpreted that all the spirits equivalent to the following claims fall within the scope of the present disclosure.

What is claimed is:

1. A speaker driver, comprising:

a pair of yoke members that is arranged to face each other so as to have empty spaces provided on inner sides thereof and fixed to a stand base;

two or more magnets that are mounted on inner side surfaces of the yoke members; and a rotating member that is provided with a voice coil disposed in parallel in a direction facing the magnet and disposed between the yoke members, and has one end rotatably coupled to the yoke members and the other end provided with a diaphragm coupling part to which a diaphragm is coupled, wherein one end of the rotating member is provided with a coupling hole to which a shaft is coupled, and the yoke member is provided with an insertion part into which an end portion of the shaft is inserted.

2. The speaker driver of claim 1, wherein a rotation support member for supporting a rotation of the rotating member is provided between an outer peripheral surface of the shaft and the coupling hole.

3. The speaker driver of claim 1, wherein each of the yoke member includes:

a magnet support member that has the magnet mounted on an inner side surface thereof and is provided with bent end portions that are bent to be stepped in a direction in which the yoke members face each other at both ends in a circumferential direction; and a yoke fixing member that is coupled to an outer side surface of the magnet support member and fixed to the stand base and has the insertion part provided on an inner side surface thereof.

4. The speaker driver of claim 3, wherein the pair of yoke members is coupled to each other by making the bent end portions of the magnet support members spaced apart from each other abut in a direction facing each other.

5. The speaker driver of claim 1, wherein the rotating member is provided with a coil coupling hole in which the voice coil is coupled between the coupling hole and the diaphragm coupling part.

6. The speaker driver of claim 5, wherein the magnet has a fan shape with a certain angle and is coupled to the coil coupling hole.

7. The speaker driver of claim 5, wherein the magnets are arranged in the same number of one or more on both sides in a circumferential direction, respectively, based on a central portion of the inner surface of the yoke member.

8. The speaker driver of claim 7, wherein the voice coil is formed to have a space on an inner side thereof in a fan shape having a certain angle.

9. The speaker driver of claim 7, wherein the voice coil is formed to have a space on an inner side thereof in a fan shape having the same angle as the magnet.

10. The speaker driver of claim 1, wherein an elastic member for applying an elastic force in a rotational direction of the rotating member is coupled between one end of the rotating member and the stand base.

11. The speaker driver of claim 10, wherein the voice coil is disposed above the shaft and the elastic member is disposed below the shaft.

12. The speaker driver of claim 10, wherein the elastic member is provided symmetrically on both sides of one end of the rotating member.

* * * * *